US008006424B1

(12) United States Patent
Ligard

(10) Patent No.: US 8,006,424 B1
(45) Date of Patent: Aug. 30, 2011

(54) STAND FOR LOADED FIREARM

(76) Inventor: Thor H. Ligard, Tulsa, OK (US)

( * ) Notice: Subject to any disclaimer, the term of this patent is extended or adjusted under 35 U.S.C. 154(b) by 1146 days.

(21) Appl. No.: 11/295,968

(22) Filed: Dec. 7, 2005

(51) Int. Cl.
*F41A 17/00* (2006.01)
*B60R 7/14* (2006.01)

(52) U.S. Cl. ..... 42/70.11; 211/64

(58) Field of Classification Search ..... 42/70.11; 211/64; 224/912, 913
See application file for complete search history.

(56) References Cited

U.S. PATENT DOCUMENTS 1,557,339 A * 10/1925 Sander ..... 224/542
3,307,755 A * 3/1967 Lentz ..... 206/317
3,419,728 A * 12/1968 Wilson ..... 307/9.1
5,579,923 A * 12/1996 Hemmerlein ..... 211/4
5,621,996 A * 4/1997 Mowl, Jr. ..... 42/70.07
6,260,300 B1 * 7/2001 Klebes et al. ..... 42/70.11
6,272,784 B1 * 8/2001 Ringers ..... 42/70.07
6,301,815 B1 * 10/2001 Sliwa ..... 42/70.01
6,568,116 B2 * 5/2003 Hathaway ..... 42/70.11
6,834,454 B2 * 12/2004 Klein ..... 42/70.11
6,843,081 B1 * 1/2005 Painter ..... 70/63
6,845,640 B2 * 1/2005 Loeff et al. ..... 70/63
2002/0032976 A1 * 3/2002 Riener ..... 42/70.11

* cited by examiner

*Primary Examiner* — Bret Hayes
(74) *Attorney, Agent, or Firm* — Gable & Gotwals

(57) ABSTRACT

A stand secures a loaded firearm in an inoperable condition for quick release to an authorized user in the event of an emergency. A housing serves as a base for the stand. A mechanism fixed to the housing prevents the firearm from firing. For example, a rod fixed to the housing is inserted through the muzzle and into the bore until it extends into an empty chamber of a revolver or into the receiver of an automatic pistol. Another mechanism mounted on the housing is operable between a first position in which it permits engagement of the firearm on and disengagement of the firearm from the rod and a second position in which it prevents disengagement of the firearm from the rod. The operating mechanism may be actuated manually by a key or electronically by a key pad, a fingerprint recognition pad or the like.

19 Claims, 7 Drawing Sheets

STAND FOR LOADED FIREARM

BACKGROUND OF THE INVENTION

This invention relates generally to accessories for firearms and more particularly concerns accessories for storing firearms not in use.

It is fairly common practice to keep a firearm in a residence or business location for the purpose of self-protection. Given the purpose for having the firearm, keeping it in an unloaded condition is hardly practical. On the other hand, keeping a loaded firearm in an insecure environment is also impractical.

It is, therefore, an object of this invention to provide a stand for a loaded firearm which will store the firearm in a readily accessible location. Another object of this invention is to provide a loaded firearm stand which can be permanently mounted on a relatively immovable object. Yet another object of this invention is to provide a loaded firearm stand which resists unauthorized disengagement of the firearm from the stand. A further object of this invention is to provide a loaded firearm stand which readily permits disengagement of the firearm from the stand by an authorized user.

SUMMARY OF THE INVENTION

In accordance with the invention, a stand is provided which secures a loaded firearm in an inoperable condition for quick release to an authorized user in the event of an emergency. A housing serves as a base for the stand.

A mechanism fixed to the housing prevents the firearm from firing. For example, a rod is fixed at one end to the housing and is oriented on the housing so that its other end can be inserted through the muzzle and into the bore until it extends into an empty chamber of a revolver or into the receiver of an automatic pistol. The extension of the rod into the empty chamber or receiver prevents firing of the firearm. Preferably, the rod is of adjustable length and the adjustable components of the rod are located and contoured for disposition within the bore when the rod extends into the empty chamber or receiver, so as to minimize any possibility of tampering with the adjustable components.

Another mechanism mounted on the housing is operable between two positions. In its first position, it permits engagement of the firearm on and disengagement of the firearm from the firing prevention mechanism. In its second position, it prevents disengagement of the firearm from the firing prevention mechanism. The mechanism preventing disengagement of the firearm from the firing preventing mechanism may, for example, be a slide reciprocally movable on the housing between two positions. In the first position, the path of removal of the firearm from the rod is cleared. In the second position, the path of removal of the firearm from the rod is obstructed. Obstruction can be accomplished in the second position by having the slide abut a rear portion of the firearm, such as a rear portion of the hammer, the trigger guard, the trigger or the slide.

The disengagement preventing mechanism may, alternatively, be the combination of a seat in the housing which receives the trigger guard when the rod is fully inserted into the firearm and a slide which reciprocates in the housing between the first and second positions. The slide clears the path of removal of the trigger guard from the seat in the first position and obstructs the path of removal of the trigger guard from the seat in the second position.

In the case of an in-housing disengagement preventing mechanism, an externally accessible operating mechanism is fixed to the housing for switching the slide between the first and second positions. In one embodiment, a key may be used to rotate an externally accessible key cylinder operably connected by a linkage to the slide. In another embodiment, the slide may extend externally of the housing and be manually pushable against a bias with a latching mechanism automatically securing the slide in the second position until a latch releasing mechanism allows the slide to be reciprocated by the bias to the first position. The automatic latching mechanism may be a solenoid biased toward engagement with the slide and the releasing mechanism may be an electronic controller disengaging the solenoid from the slide. The electronic controller may be a key pad, a fingerprint recognition pad or the like.

For automatic pistols another mechanism, such as a bracket mounted and oriented on the housing to extend below the butt of the pistol in the second condition, may also be used to prevent removal or insertion of a clip from the pistol grip.

BRIEF DESCRIPTION OF THE DRAWINGS

Other objects and advantages of the invention will become apparent upon reading the following detailed description and upon reference to the drawings in which.

While the invention will be described in connection with several embodiments thereof, it will be understood that it is not intended to limit the invention to those embodiments or to the details of the construction or arrangement of parts illustrated in the accompanying drawings.

DETAILED DESCRIPTION

Figure 1:
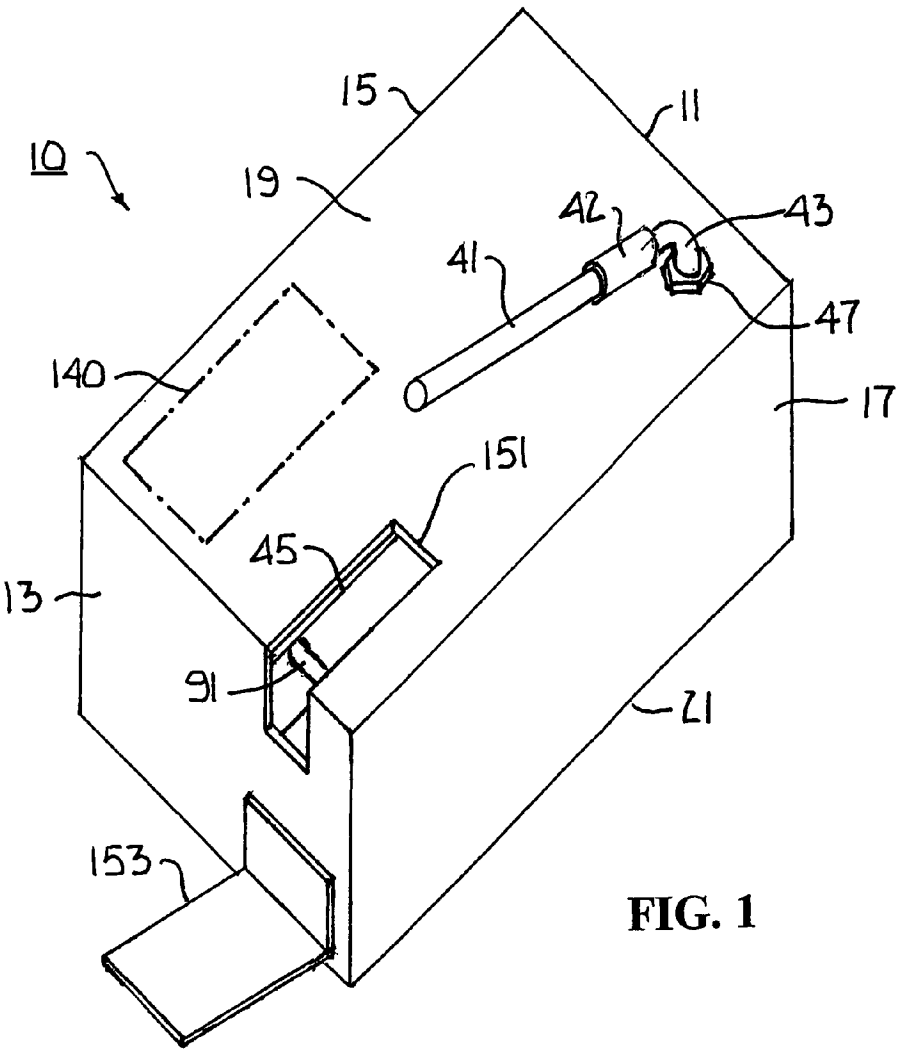
FIG. 1 is a perspective view of a first embodiment of the firearm stand.

Turning first to FIG. 1, the loaded firearm stand includes a base 10 which supports and/or contains the other components of the stand. The base 10 shown is a box-like housing having front 11, rear 13, left side 15, right side 17 and top 19 walls. The walls may be steel or any other suitable material of corresponding thickness to inhibit violent access to the contents of the housing or distortion of the alignment of its structural components. The base 10 need not necessarily be box-like or orthogonal.

Figure 2:
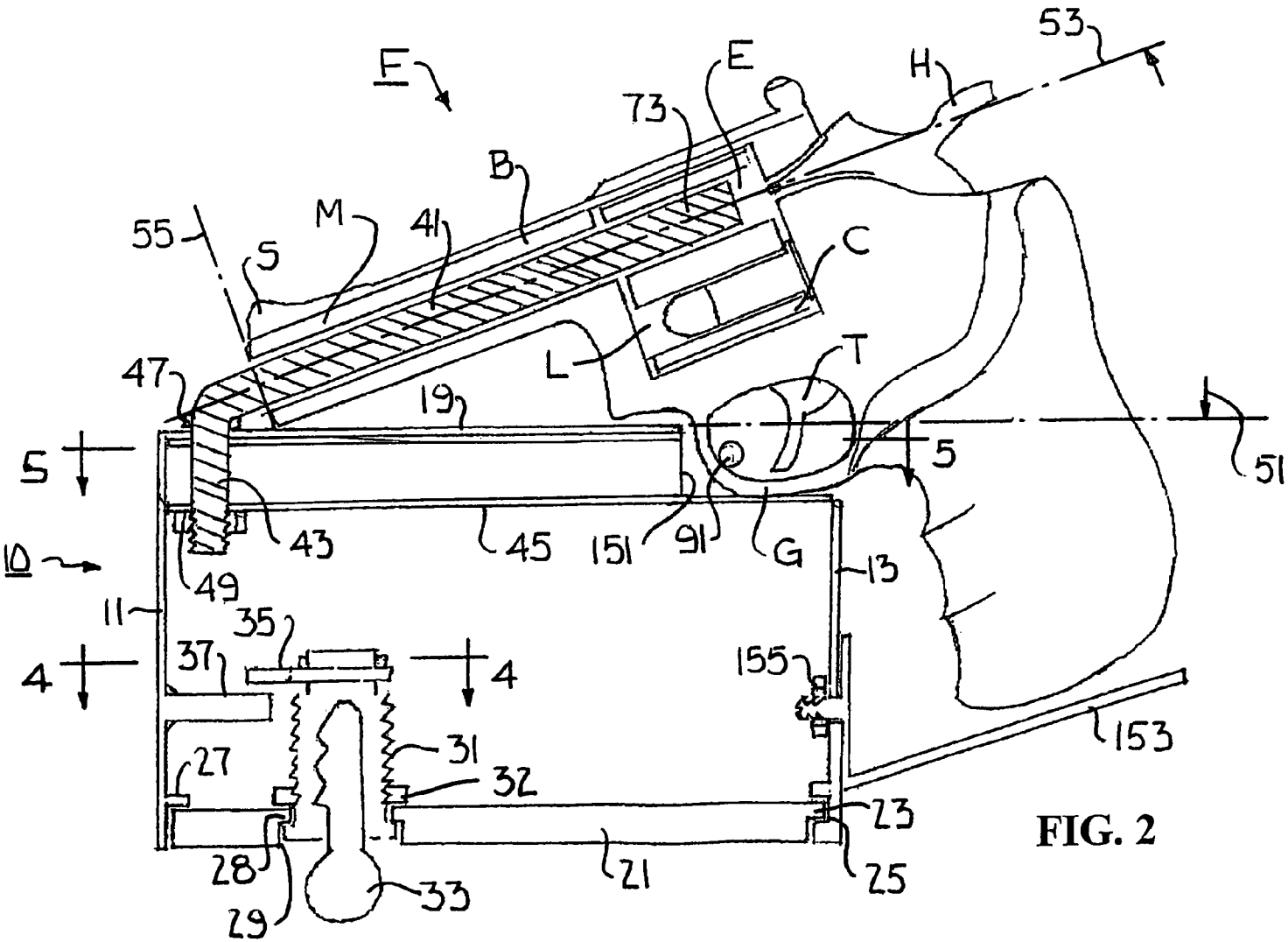
FIG. 2 is a cross-sectional view of the stand of FIG. 1 taken in a vertical plane extending diametrically through the barrel of a revolver mounted thereon.
Figure 3:
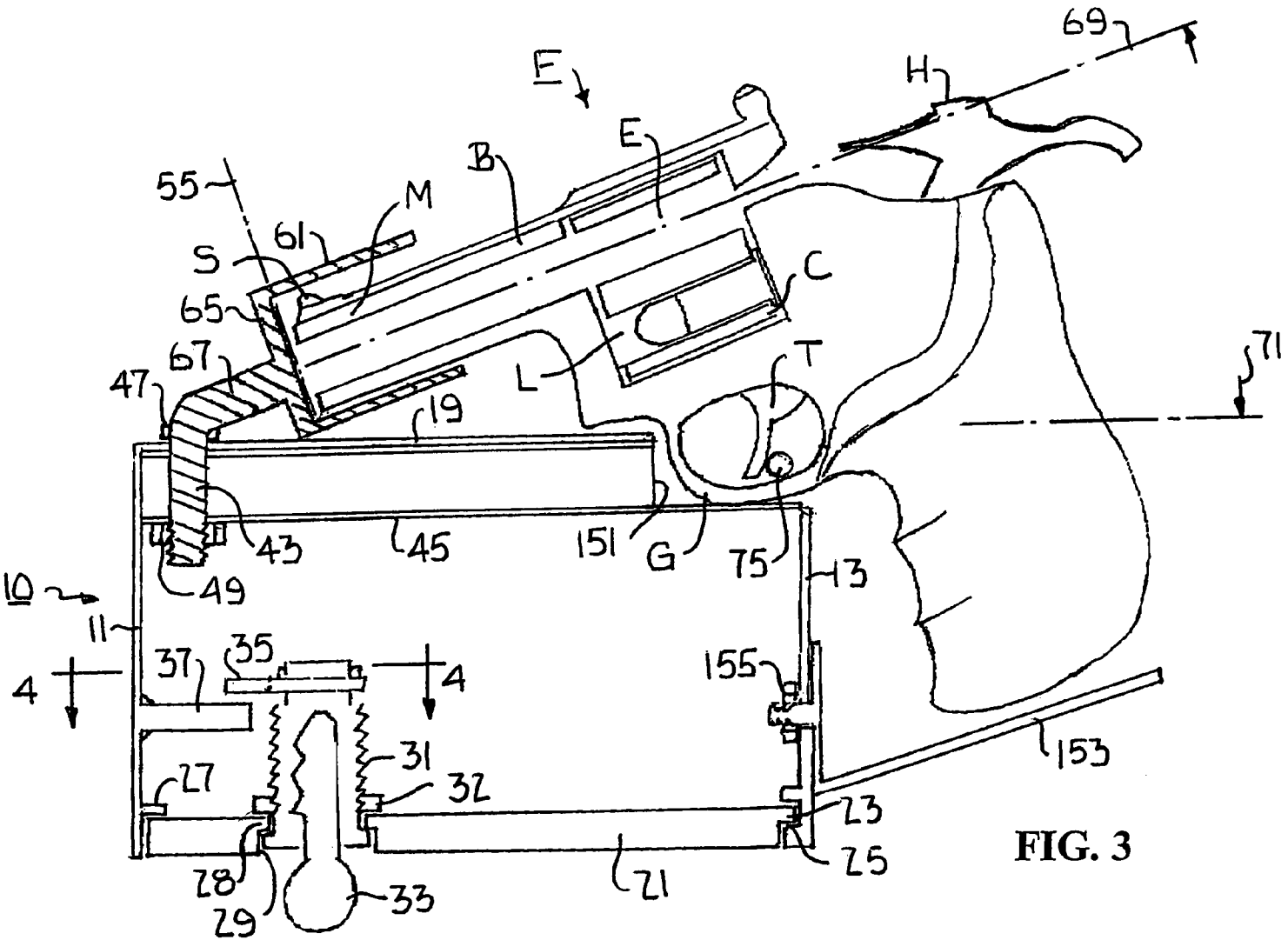
FIG. 3 is a cross-sectional view of another embodiment of the firearm stand taken in a vertical plane extending diametrically through the barrel of a revolver mounted thereon.
Figure 4:
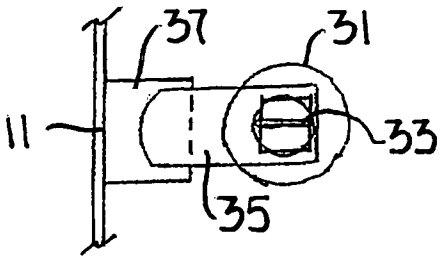
FIG. 4 is a cross sectional view taken along the line 4-4 of FIGS. 2 and 3.

Looking at FIGS. 2 and 3, the base 10 also has a removable bottom cover 21 which closes the housing. As shown, the cover 21 hinges at one end 23 in a groove 25 in the lower inside surface of the rear wall 13 into abutment against a seat 27 along the lower inside surface of the front wall 11. Looking also at FIG. 4, a lock cylinder 31 is mounted on the cover 21. A lock ring 32 threaded on the cylinder 31 engages the cylinder 31 against a flange 28 of an opening 29 in the cover 21. The keyway is accessible to the key 33 from outside of the housing and the linkage 35 rotates within the housing to engage a flange 37 on the inside surface of the front wall 11 to lock the cover 21 to the base 10. Other cover configurations and methods of operation can be used, provided the resulting locked housing inhibits violent access to the contents of the housing or distortion of the alignment of the structural components.

Continuing to look at FIGS. 2 and 3, the stand also includes a mechanism mounted on the base 10 for limiting engagement and disengagement of the firearm F to and from the base 10 to forward and rearward axial motion, respectively, of the firearm F relative to the base 10. In the embodiment of FIG. 2, the motion restricting mechanism is a rod 41 fixed at one end 43 to the base 10. As shown, a reinforcing tube 45 is mounted against the underside of the top wall 19 of the base 10 and the end 43 of the rod 41 extends through holes in the top wall 19 and the reinforcing tube 45 into the housing. Exterior and interior lock nuts 47 and 49 secure the rod 41 in place on the base 10. The exposed portion of the rod 41 is oriented at an angle 51 for insertion into the muzzle M of the firearm F. The barrel B of the firearm F restricts motion of the firearm F on the rod 41 to motion along the rod axis 53. The forwardmost position 55 of the firearm F on the rod is determined by contact of the trigger guard G against the reinforcing tube 151 or by contact of the muzzle M on the top wall 19 of the base 10 depending on the length of the barrel B. Once on the rod 41 in the forwardmost position 55, axial motion of the firearm F is substantially limited to reward motion on the axis 53.

As best seen in FIG. 1, the rod 41 is of adjustable length. For example, one or more threaded extensions 42 can be used to extend the rod 41 or replace an extension of different length. The adjustable components 42 of the rod 41 are located and contoured for disposition within the barrel B so as to minimize any possibility of tampering with the adjustable components 42. In the embodiment of FIG. 3, the motion restricting mechanism is a sleeve 61 fixed at one end to the base 10. As shown, the mounting end 43 of a rod is secured to the base 10 in the same manner as the rod 41 was secured to the base 10 in FIG. 2. The closed forward end 65 of the sleeve 61 is fixed to the exposed end 67 of the rod with the sleeve axis 69 oriented at an angle 71 to receive the nozzle M of the firearm F. The forwardmost position 55 of the firearm F in the sleeve 61 is determined by contact of the trigger guard G against the reinforcing tube 151 or by contact of the muzzle M with the closed end 65 of the sleeve 61 depending on the length of the barrel B. Once in the sleeve 61 in the forwardmost position 55, axis motion of the firearm F is substantially limited to rearward motion on the axis 69. Other mechanisms may be used to limit axis motion of the firearm F. The materials and dimensions of the components of any axial motion limiting mechanism must be such as to inhibit violent distortion of the alignment of its structural components.

Considering FIGS. 2, 3, 8 and 9, the stand also includes a mechanism cooperable with the firearm F in a loaded condition to prevent firing of the firearm F when the firearm F is in the fixed forwardmost position 55 on the base 10. As seen in FIG. 2, the anti-firing mechanism is an extension 73 of the rod 41 into an empty chamber E of the firearm F. The rod extension 73 prevents rotation of a revolver cylinder C which would align a loaded chamber L for firing. Similarly, the extension 73 of the rod 41 into the empty chamber of an automatic pistol would prevent a shell from being fed from a clip or magazine into the chamber. As seen in FIG. 3, the anti-firing mechanism is a pin 75 mounted for reciprocal travel into and out of abutment with the back of the trigger T of the firearm F along an axis transverse, as shown perpendicular, to the axis 69. The pin 75 prevents the trigger T from being pulled sufficiently to fire the firearm F. Looking at FIGS. 8 and 9, similar arrangements of pins 77 and 79 behind an uncocked hammer H and in front of a cocked hammer H, respectively, will prevent the hammer H from moving sufficiently to fire the firearm F. Again, the materials and corresponding dimensions of any components of the anti-firing mechanism must be such as to inhibit violent distortion of the alignment of its structural components.

Figure 9:
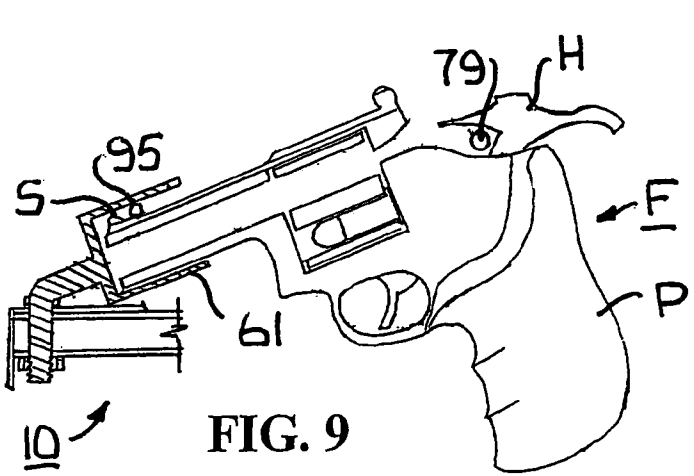
FIG. 9 is a cross sectional view taken in a vertical plane extending diametrically through the barrel of a cocked revolver mounted on the stand of FIG. 3 and illustrating possible alignments of the firing prevention and/or firearm disengagement mechanisms.
Figure 8:
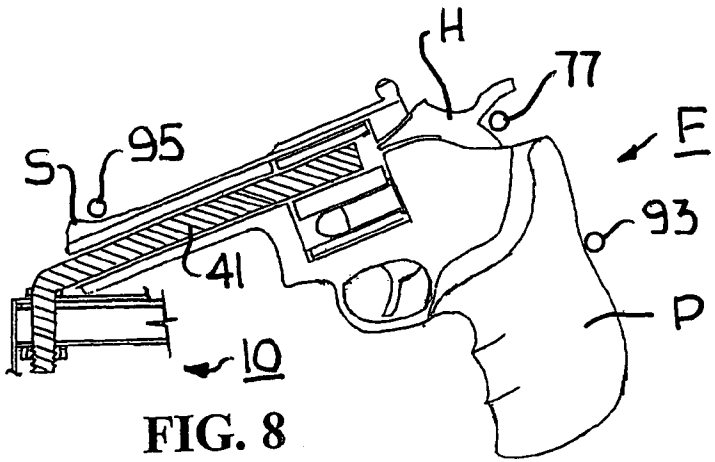
FIG. 8 is a cross sectional view taken in a vertical plane extending diametrically through the barrel of an uncocked revolver mounted on the stand of FIG. 2 and illustrating possible alignments of the firing prevention and/or firearm disengagement mechanisms.

Still considering FIGS. 2, 3, 8 and 9, the stand further includes a mechanism mounted on the base 10 and operable along an axis transverse, as shown perpendicular, to the axial motion of the firearm F. This mechanism operates between a first position in which the firearm F can move axially to and from its fixed fowardmost position 55 on the base 10 and a second position in which the firearm F cannot move axially rearwardly from its fixed forwardmost position sufficiently to disengage the anti-firing mechanism and permit firing of the firearm F. As seen in FIG. 2, the anti-release mechanism is a pin 91 mounted on the base 10 for reciprocal travel into and out of abutment with the back of the front wall of the trigger guard G of the firearm F along the transverse axis. As seen in FIG. 3, the anti-release mechanism is the same pin 75 which serves as the anti-firing mechanism. As seen in FIG. 8, the anti-release mechanism may be the same pin 77 which serves as the anti-firing mechanism behind an uncocked hammer H or a pin 93 which moves into and out of abutment with the back of the pistol grip P. As seen in FIGS. 8 and 9, the anti-release mechanism may be a pin 95 which moves into and out of abutment with the back of the front sight S of the firearm F.

Looking at FIGS. 2 and 5-7, the operation of the pins 75, 77, 79, 91, 93 and 95 as anti-firing or anti-release mechanisms or both can be understood in relation to the operation of the trigger guard anti-release pin 91 of FIG. 2. The pin 91 is aligned to reciprocate in holes 101 in the structure of the base 10. As shown, the holes 101 are in the reinforcing tube 45 and the right side wall 17. Other structural members could be added to permit the desired reciprocal alignment of the pin 91 or any of the pins 75, 77, 79, 93 or 95. As shown, the pin 91 reciprocates between a first position 103 in which rearward axial motion of the trigger guard G and firearm F from the fixed forwardmost position 55 is permitted and a second position 105 in which rearward axial motion of the trigger guard G and firearm F from the fixed forwardmost position 55 is prevented.

Figure 5:
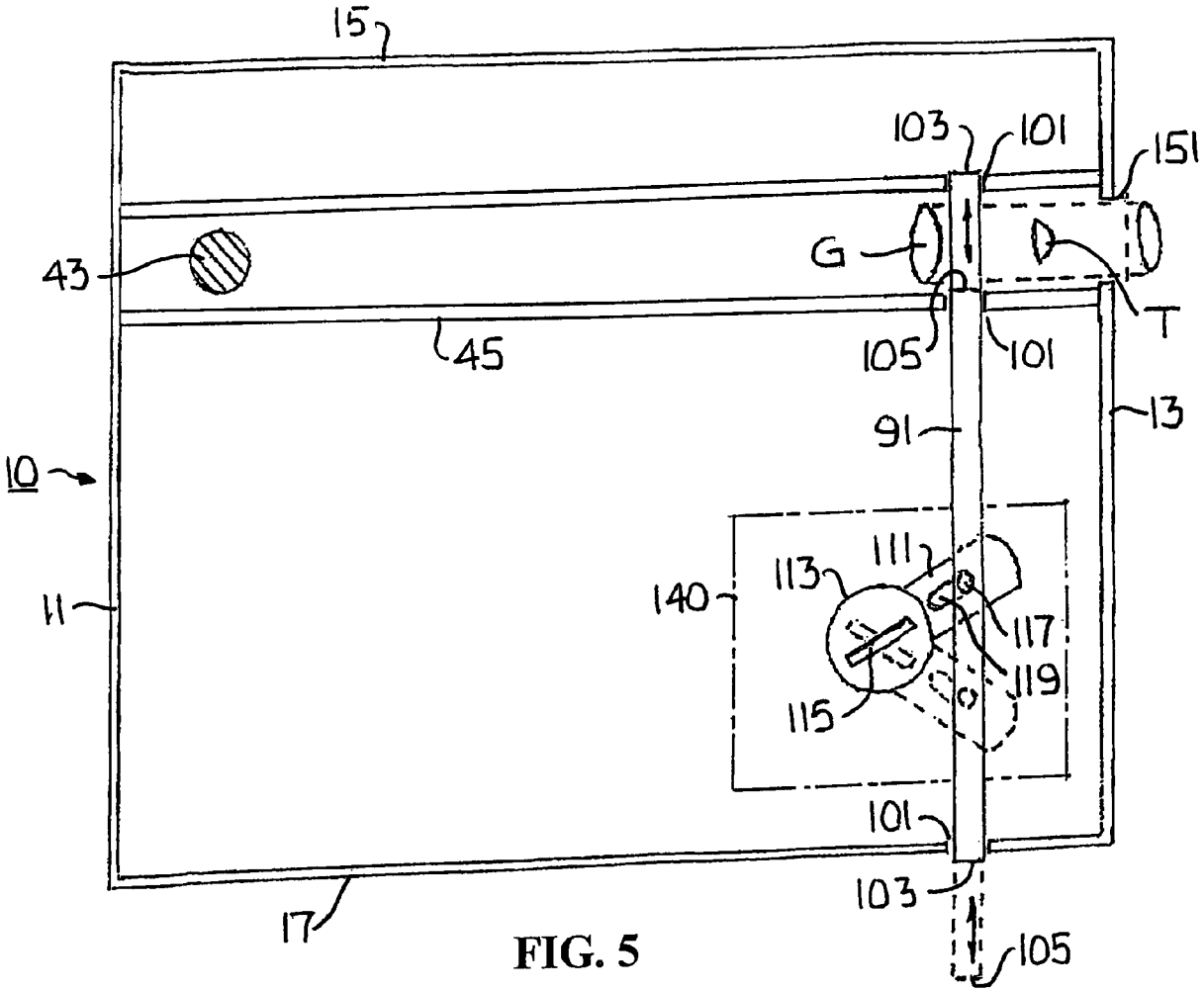
FIG. 5 is a cross-sectional view taken along the line 5-5 of FIG. 2 and illustrating a key operated embodiment of the stand.
Figure 6:
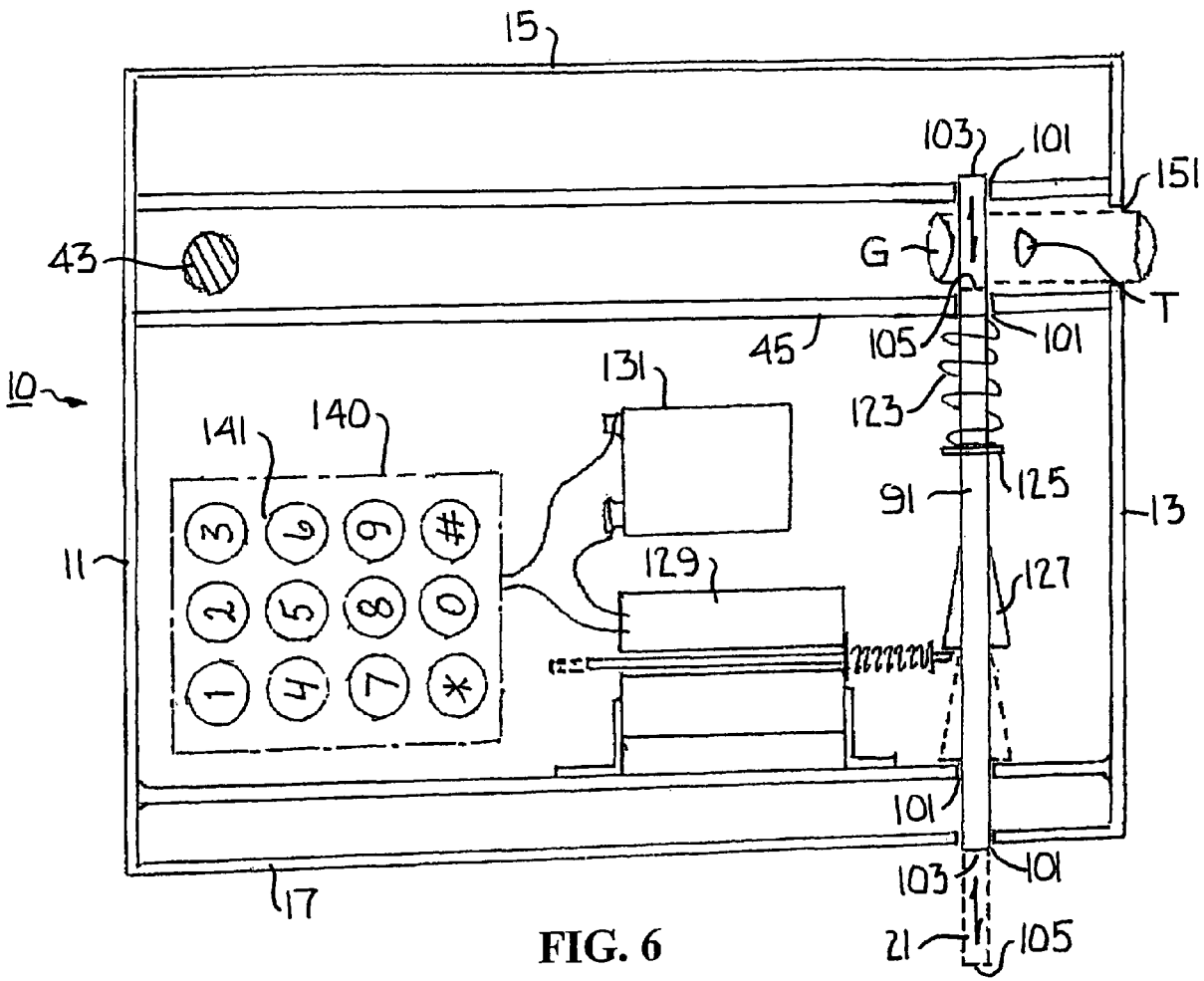
FIG. 6 is a cross-sectional view taken along the line 5-5 of FIG. 2 and illustrating a key pad operated embodiment of the stand.
Figure 7:
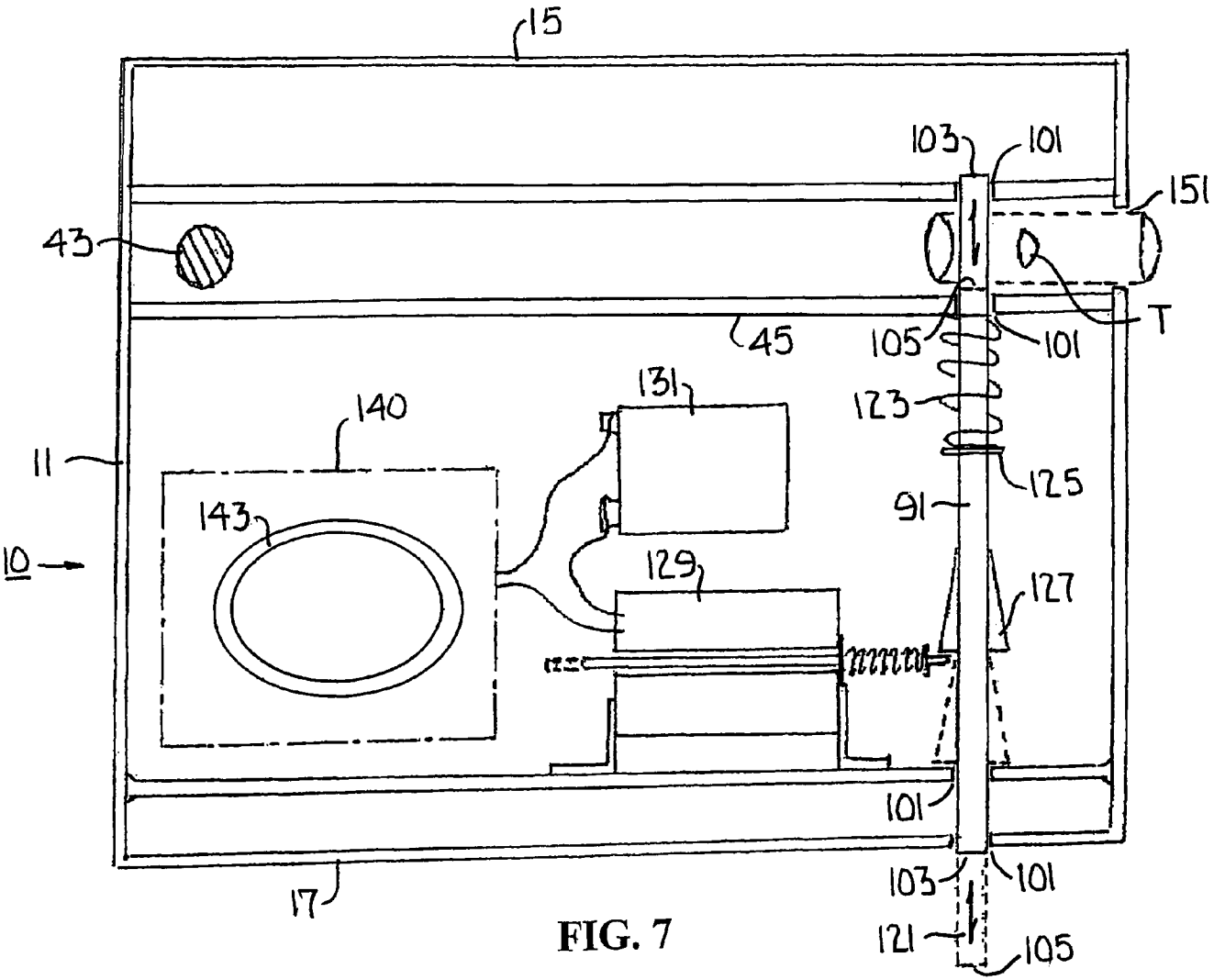
FIG. 7 is a cross-sectional view taken along the line 5-5 of FIG. 2 and illustrating a fingerprint pad operated embodiment of the stand.

As seen in FIGS. 5, 6 and 7, the stand also includes a mechanism for locking the anti-release mechanism in its anti-release position. In FIG. 5, the operation of the pin 91 can be accomplished, for example, by operation of a rotating linkage 111 on a lock cylinder 113 manually rotated by use of a key 115. A post 117 on the pin 91 is engaged in a slot 119 in the linkage 111. Rotation of the key 115 causes reciprocation of the pin 91 between its first and second positions 103 and 105 and removal of the key 115 leaves the pin 91 locked in its second position. In FIGS. 6 and 7, as further examples, the operation of the pin 91 can be accomplished by manually pushing an exposed end 121 of the pin 91 inwardly against the bias of a spring 123 compressed between the reinforcing tube 45 and a stop ring 125 on the pin 91 until a stop member or cone 127 on the pin 91 is engaged by a solenoid 129 mounted in the base 10 to hold the pin 91 in the first position 103. The solenoid 129 is powered by an electrical source such as a battery 131 in the housing so that, when energized, the solenoid 129 releases the pin 91 to the bias of the spring 123, returning the pin 91 to its second position 105. Until the solenoid 129 is engaged, the pin 91 remains locked in its second position.

Returning to FIG. 1, the stand includes a member 140 externally accessible on the base 10 for unlocking the locking mechanism to permit authorized removal of the firearm F from the stand. By way of example, as seen in FIG. 5, the accessible member is the lock cylinder key hole 116. As seen in FIG. 6, the accessible member is an electronic key pad 141 in the circuit of the solenoid 129. As seen in FIG. 7, the accessible member is an electronic fingerprint reader 143. Except for the accessible operating member, the unlocking and locking mechanism is contained within the housing.

As seen in FIGS. 1-3 and 5-7, the pin 91 in the second position 103 of the anti-release mechanism is entirely within the base 10. As best seen in FIG. 1, a slot 151 is provided in the base 10 to receive the trigger guard G. The external structure of the base 10 can be similarly modified to enclose any of the pins 75, 77, 79, 93 and 95. Furthermore, as best seen in FIGS. 1-3, a bracket 153 can be mounted on the exterior of the rear wall 13 of the base 10, as by use of one or more nuts 155, to obstruct the magazine or clip passage of an automatic pistol.

The stand can be disguised to some extent by combination in a lamp, clock or telephone stand or the like. It can be mounted on furniture or a wall or the like or be free standing. For example, the cover 21 may be secured to a suitable object, such as the top of a night table (not shown), by bolts (not shown). A hole can be drilled through the night table which is aligned with the lock cylinder 31. Thus, the cover 21 can be bolted to the night table and the base 10 can be locked to the cover 21 or unlocked and removed from the cover 21.

Thus it is apparent that there has been provided, in accordance with the invention, a stand for a loaded hand gun that fully satisfies the objects, aims and advantages set forth above. While the invention has been described in conjunction with several embodiments thereof, it is evident that many alternatives, modifications and variations will be apparent to those skilled in the art and in light of the foregoing description. Accordingly, it is intended to embrace all such alternative, modifications and variations as fall within the spirit of the appended claims.

What is claimed is:

1. A stand for a firearm comprising;

a base;

means mounted on said base for limiting engagement and disengagement of the firearm to and from said base to forward and rearward axial motion, respectively, of the firearm to and from a fixed forwardmost position of the firearm relative to said base;

means cooperable with said firearm in a loaded condition to prevent firing of the firearm when the firearm is in said fixed forwardmost position on said base; and means mounted on said base and operable along an axis transverse to said firearm axial motion between a first position for permitting said axial motion of the firearm to and from said fixed forwardmost position and a second position for preventing said rearward axial motion of the firearm from said fixed forwardmost position, said base having means mounted thereon for preventing insertion and removal of a magazine into and from a butt end of the firearm.

2. A stand according to claim 1, said means for limiting comprising a rod fixed at one end to said base and oriented for insertion at another end into a muzzle of the firearm.

3. A stand according to claim 1, said means for limiting comprising a sleeve fixed at one end to said base and oriented for insertion into another end of said sleeve of a muzzle of the firearm.

4. A stand according to claim 1, said means for limiting comprising a rod fixed at one end to said base and oriented for insertion at another end into a muzzle of the firearm and said means for cooperating comprising an extension of said rod into an empty chamber of the firearm.

5. A stand according to claim 1, said means for cooperating comprising a pin mounted on said base for reciprocal travel along an axis transverse to said single axis into and out of abutment with a back of a trigger of the firearm.

6. A stand according to claim 1, said means for cooperating comprising a pin mounted on said base for reciprocal travel along an axis transverse to said single axis into and out of abutment with a front of a cocked hammer of the firearm.

7. A stand according to claim 1, said means for cooperating comprising a pin mounted on said base for reciprocal travel along an axis transverse to said single axis into and out of abutment with a back of an uncocked hammer of the firearm.

8. A stand according to claim 1, said means for permitting and preventing comprising a pin mounted on said base for reciprocal travel along said transverse axis into and out of abutment with a back of a trigger of the firearm.

9. A stand according to claim 1, said means for permitting and preventing comprising a pin mounted on said base for reciprocal travel along said transverse axis into and out of abutment with a back of a front wall of a trigger guard of the firearm.

10. A stand according to claim 1, said means for permitting and preventing comprising a pin mounted on said base for reciprocal travel along said transverse axis into and out of abutment with a back of a grip of the firearm.

11. A stand according to claim 1, said means for permitting and preventing comprising a pin mounted on said base for reciprocal travel along said transverse axis into and out of abutment with a back of an uncocked hammer of the firearm.

12. A stand according to claim 1, said means for permitting and preventing comprising a pin mounted on said base for reciprocal travel along said transverse axis into and out of abutment with a back of a front sight of the firearm.

13. A stand according to claim 1, said base being configured to contain said means for cooperating with said firearm.

14. A stand according to claim 1, said base being configured to contain said means for permitting and preventing.

15. A stand according to claim 1 further comprising means for locking and unlocking said means for permitting and preventing in and from, respectively, said second position.

16. A stand for a firearm comprising:

a base;

means mounted on said base for limiting engagement and disengagement of the firearm to and from said base to forward and rearward axial motion, respectively, of the firearm to and from a fixed forwardmost position of the firearm relative to said base;

means cooperable with said firearm in a loaded condition to prevent firing of the firearm when the firearm is in said fixed forwardmost position on said base;

means mounted on said base and operable along an axis transverse to said firearm axial motion between a first position and a second position for preventing said rearward axial motion of the firearm from said fixed forwardmost position; and means for locking and unlocking said means for permitting and preventing in and from, respectively, said second position, said means for locking and unlocking comprising a mechanically operable linkage connected between said permitting and preventing means and a key operated cylinder externally accessible on said base.

17. A stand for a firearm comprising:

a base;

means mounted on said base for limiting engagement and disengagement of the firearm to and from said base to forward and rearward axial motion, respectively, of the firearm to and from a fixed forwardmost position of the firearm relative to said base;

means cooperable with said firearm in a loaded condition to prevent firing of the firearm when the firearm is in said fixed forwardmost position on said base;

means mounted on said base and operable along an axis transverse to said firearm axial motion between a first position and a second position for preventing said rearward axial motion of the firearm from said fixed forwardmost position; and means for locking and unlocking said means for permitting and preventing in and from, respectively, said second position, said means for locking and unlocking comprising an electromagnetically operable linkage connected between said permitting and preventing means and an electronic key pad externally accessible on said base.

18. A stand for a firearm comprising:

a base;

means mounted on said base for limiting engagement and disengagement of the firearm to and from said base to forward and rearward axial motion, respectively, of the firearm to and from a fixed forwardmost position of the firearm relative to said base;

means cooperable with said firearm in a loaded condition to prevent firing of the firearm when the firearm is in said fixed forwardmost position on said base;

means mounted on said base and operable along an axis transverse to said firearm axial motion between a first position and a second position for preventing said rearward axial motion of the firearm from said fixed forwardmost position; and means for locking and unlocking said means for permitting and preventing in and from, respectively, said second position, said means for locking and unlocking comprising an electromagnetically operable linkage connected between said permitting and preventing means and an electronic fingerprint reader externally accessible on said base.

19. A stand for a firearm comprising:

a base;

means mounted on said base for limiting engagement and disengagement of the firearm to and from said base to forward and rearward axial motion, respectively, of the firearm to and from a fixed forwardmost position of the firearm relative to said base;

means cooperable with said firearm in a loaded condition to prevent firing of the firearm when the firearm is in said fixed forwardmost position on said base;

means mounted on said base and operable along an axis transverse to said firearm axial motion between a first position and a second position for preventing said rearward axial motion of the firearm from said fixed forwardmost position; and means for locking and unlocking said means for permitting and preventing in and from, respectively, said second position, said base being configured to contain said means for locking and unlocking.

* * * * *